United States Patent [19]

Vona, Jr. et al.

[11] 4,018,067

[45] Apr. 19, 1977

[54] OSCILLATING WASHER AGITATOR

[75] Inventors: Nick Vona, Jr., Springboro; Kenneth O. Sisson, Dayton, both of Ohio

[73] Assignee: General Motors Corporation, Detroit, Mich.

[22] Filed: May 26, 1976

[21] Appl. No.: 690,190

[52] U.S. Cl. ..... 68/134

[51] Int. Cl.[2] ..... D06F 13/02

[58] Field of Search ..... 68/131–134, 68/23.7, 53, 54, 138, 154, 174

[56] References Cited

UNITED STATES PATENTS

| | | | |
|---|---|---|---|
| 1,629,391 | 5/1927 | Kemp et al. | 68/133 |
| 1,795,395 | 3/1931 | Hoke | 68/134 |
| 2,726,529 | 12/1955 | Clark | 68/133 |
| 3,112,632 | 12/1963 | Walton | 68/54 |
| 3,381,504 | 5/1968 | Smith | 68/134 X |
| 3,648,486 | 3/1972 | Rosinski et al. | 68/134 X |
| 3,651,672 | 3/1972 | Salisbury | 68/134 |

*Primary Examiner*—Philip R. Coe

*Attorney, Agent, or Firm*—Frederick M. Ritchie

[57] ABSTRACT

An agitator for a horizontally oscillating clothes washer includes a hollow perforate column on a flared skirt configured to provide three distinct levels of agitator action. The first and second levels comprise four triangular fins. The first or upper level of each fin helps submerge dry articles by pulling them downwardly, channelizes the articles between the fins to keep the articles in straight toroidal planes, and beats bellow-causing air out of the articles without generating a "suds lock" condition. The second or intermediate level provides just enough circulation to maintain the articles loose, unbunched, and channelized. The third or bottom level comprises four rounded vanes projecting upwardly from the skirt with each vane having a decreasing cross section in the radially outer direction. The outer bottom edge of each vane is rooted to the skirt by a thin web, the decreasing cross section in combination with the thin web allowing the vane to flex in a controlled pattern when under load.

3 Claims, 8 Drawing Figures

OSCILLATING WASHER AGITATOR

This invention relates to a clothes washer and, more particularly, to an improved agitator for horizontally oscillating clothes in the washer.

BACKGROUND

The purpose of an agitator in a washing machine is to mechanically agitate the articles to be washed in such a manner as to optimize the soil removing and other beneficial properties of washing aides such as detergent, bleach and fabric softener. At the same time agitation should not cause undue damage to the articles being washed and should use a minimum amount of energy. Also the agitator should not cause problems under adverse conditions such as low voltage, overloads, or too much detergent.

We have observed current pulsating washers, and found that the above advantages can be accomplished with a relatively slowly turning toroid of articles being washed. An agitator should submerge the articles quickly and provide a slowly turning toroid for washability. It must not tangle the articles nor be overly harsh on them. Moreover, an agitator must do this for a variety of article types and load sizes and under many operating conditions. We believe our agitator substantially meets these criteria.

Many prior art agitators have been designed for horizontal rather than pulsating agitation. Some have triangular shaped, generally rigid fins arranged vertically along an upstanding column to project radially therefrom. Others have radially directed vanes on the agitator column which flex as the agitator oscillates horizontally back and forth. Still others have flexible vanes projecting from a hollow perforate column so that the toroidal circulation produced by the agitator may include the hollow of the column.

The agitator of this invention, like the prior art agitators, is for a horizontally oscillating type clothes washer. However, our agitator has a hollow perforate column on a flared circular base or skirt and is configured to provide three distinct levels of agitator action. The first and second levels comprise four triangular fins vertically along a perforate column. The first or upper level which comprises about two-thirds of each fin including the apex thereof, helps submerge dry articles by pulling them downwardly, channelizes the articles between the fins to keep the articles in straight toroidal planes, and beats bellow-causing air out of the articles — all without generating a "suds lock" condition.

The second or intermediate level comprises the lower one-third portion of each fin which is slightly tapered to provide just enough circulation to maintain the articles loose, unbunched, and channelized.

The third or bottom level comprises four rounded vanes projecting upwardly from the base or skirt with each vane having a decreasing cross section in the radially outer direction. The outer bottom edge of each vane is rooted to the base by a thin web, the decreasing cross section in combination with the thin web allowing the vane to flex in a controlled pattern when under load.

Accordingly, it is a general object of this invention to provide a horizontally oscillatable agitator configured upon oscillation thereof in a clothes and water-filled tub to produce a moving toroid of clothes that are loose, unbunched and channelized.

Another object is to provide an agitator adapted for horizontal oscillation which has a hollow perforate column on a flared circular skirt, triangular fins vertically affixed on the column and upstanding vanes flexibly affixed on the skirt, thereby combining upon oscillation thereof to produce three distinct levels of agitator action.

Another object is to provide an agitator like that in the last object wherein the vanes on the skirt have a blended decreasing cross section in the radially outer direction leading to a rounded terminus which is rooted to the skirt by a thin web, the decreasing cross section in combination with the thin web allowing the vane to flex in a controlled pattern when under load.

Further objects and advantages of the present invention will be apparent from the following description, reference being had to the accompanying drawings wherein a preferred embodiment of the present invention is clearly shown.

IN THE DRAWINGS

Figure 1:
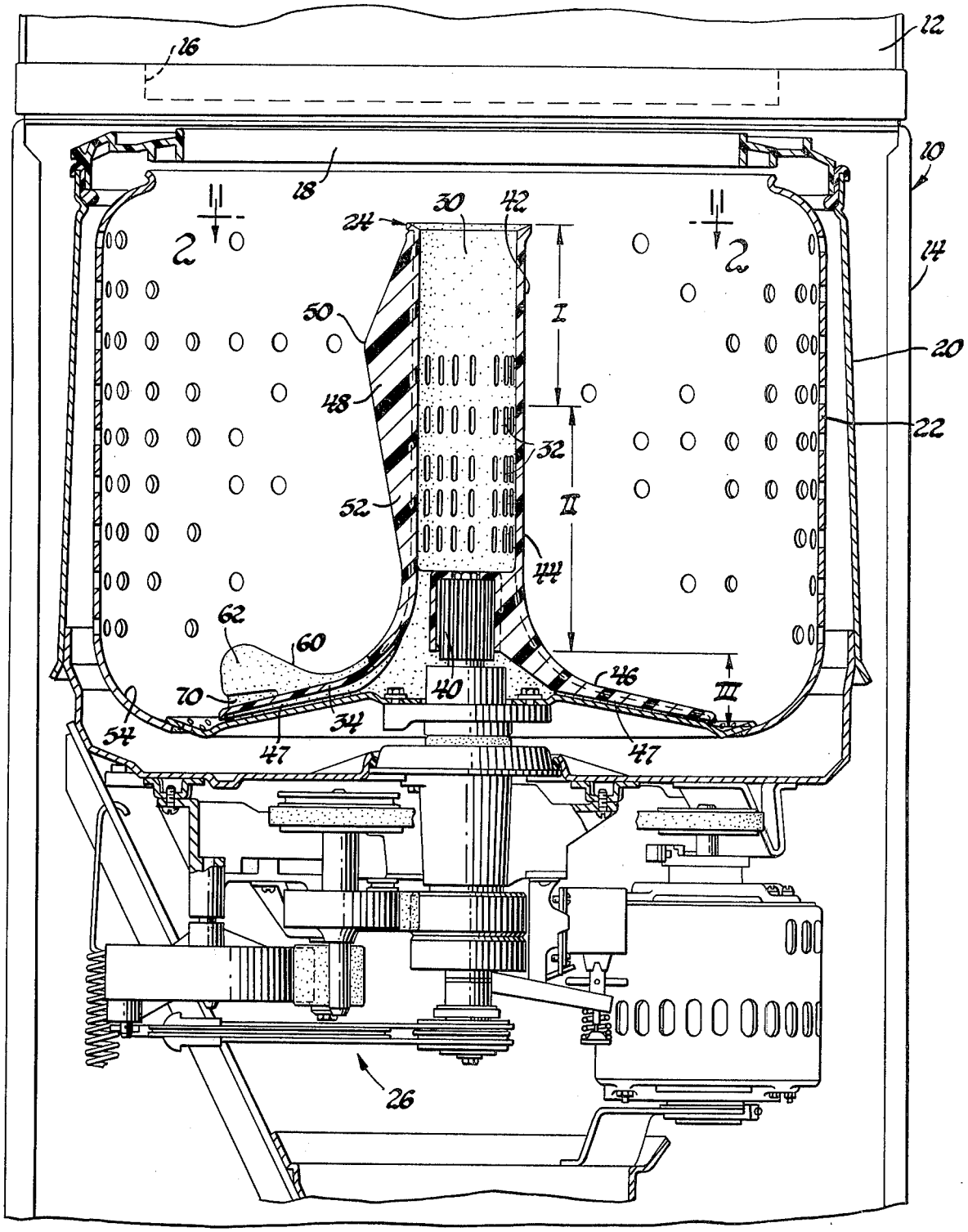
FIG. 1 is a fragmentary side elevational view of a domestic clothes washer, partly in section to show the improved agitator of this invention.
Figure 2:
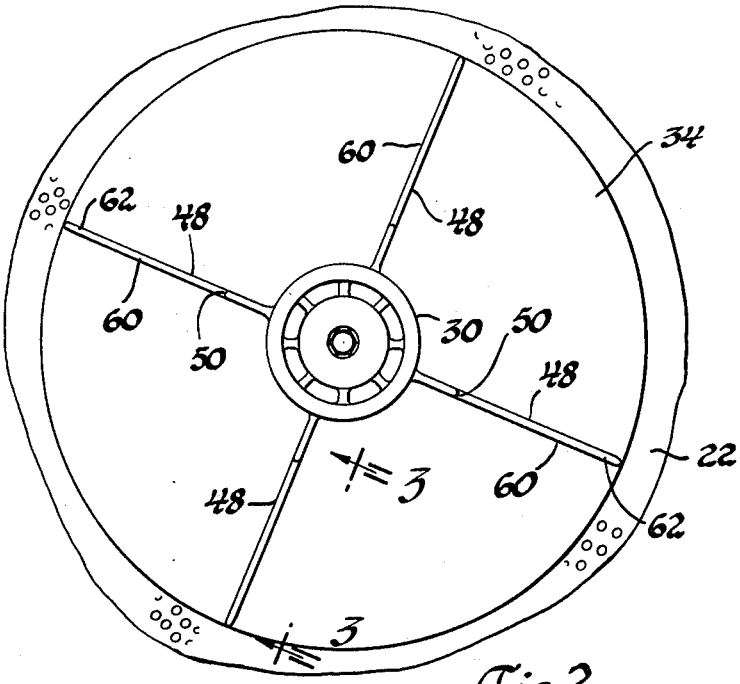
FIG. 2 is a top elevational view of the agitator taken in the direction of 2—2 in FIG. 1.
Figure 6:
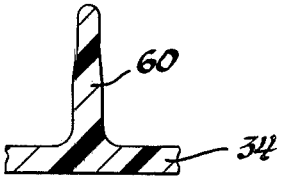
FIGS. 4, 5, 6 and 7 are fragmentary sectional views taken respectively along like-numbered lines in FIG. 3.

In accordance with this invention and with reference to FIG. 1, a clothes washer 10 is comprised of a control housing 12 and a casing 14. The casing 14 is provided with an upwardly opening access lid 16 through which clothes and other household articles are loaded into the washer. Located within the casing 14 is a cylindrical water container or outer tub 20 having an access opening 18 beneath the lid. Concentric with the water container 20 is a perforate inner tub or spin tub 22 which is rotatably mounted with respect to the water container 20. Concentrically mounted within the spin tub 22 is the horizontally oscillatable agitator 24 of this invention which operates to circulate or agitate water admitted to the spin tub through a conventional water supply (not shown). Mounted directly below the water container 20 is an agitating and spin mechanism 26. Conventional washer controls and timer means are included to selectively admit water or washing fluid to the water container 20 and to control the agitating and spin mechanism 26 so as to selectively horizontally oscillate the agitator 24 or rotate the spin tub 22. A pump (not shown) is utilized to drain water which is in the water container 20 before spin and which is centrifugally removed from the clothes during spin. Further details of the agitating and spin mechanism 26 and the operation thereof are set forth in the U.S. Pat. to Sisson No. 3,772,925, issued Nov. 20, 1973. It should be understood however, that the above-described arrangement of agitator 24, spin tub 22, water container 20, and mechanism 26 is merely representative of a typical washing machine having a rotatably driven spin tub and a horizontally oscillatable agitator.

Before operation of the washing machine 10, clothes or other household washing load are inserted into the spin tub 22 through the access lid opening 16. A predetermined quantity of water is then supplied to the water container and spin tub. During operation the water container 20, rotatable spin tub 22, agitator 24, and the agitating and spin mechanism 26 are mounted as a unitary movable mass system within the casing 14. Such movable mass system may be carried on a suspension system of the type described in U.S. Pat. No. 3,922,891.

Figure 8:
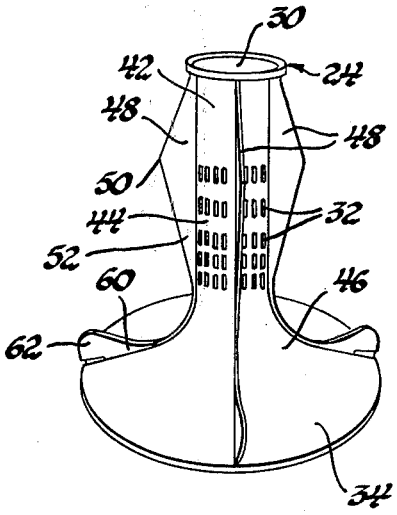
FIG. 8 is a prospective view of the improved agitator of this invention.

The agitator of this invention will now be described with reference to FIG. 8 wherein agitator 24 is shown generally comprised of a hollow column 30 having perforations 32 in the sidewall thereof and flaring at the base thereof into a skirt 34.

In particular and with reference to FIG. 1, the agitator effects cleaning of fabrics in the water and clothes or fabric receiving tub 22 when drive mechanism 26 imparts to said agitator pivotal oscillation about a vertical axis. The skirt 34 of the agitator has a socket 40 adapted for mounting the agitator generally vertically in the tub and for connecting the agitator to the drive mechanism 26. The agitator includes along the center column thereof an upper level action portion 42, a middle level action portion 44 and a lower level action portion 46. A plurality of ribs 47 may also be included on the underside of skirt 34.

Four generally vertical fins 48 are molded integrally with the center column 30 from polypropylene. Each fin projects radially from the center column in each of the action portions 42, 44 and 46. Each fin is configured as a flat obtuse triangle in the upper and middle level action portions 42, 44 to pull dry fabric articles downwardly into water in the tub while channelizing them loosely suspended in a toroidal turnover between vertical planes defined by adjacent fins. Each fin is configured in the lower level action portion 46 as a radial vane 60 gradually increasing in height in the radially outer direction to form a rounded terminus 62 projecting vertically upwardly from said skirt 34 for imparting energy to the water to move the articles being washed radially outwardly along said skirt and upwardly along a sidewall of tub 22, thereby to maintain the toroidal turnover of the articles.

Figure 7:
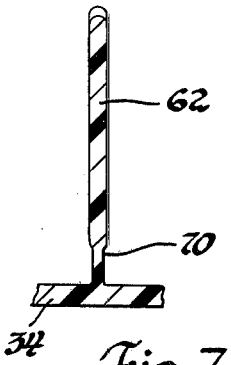
Figure 3:
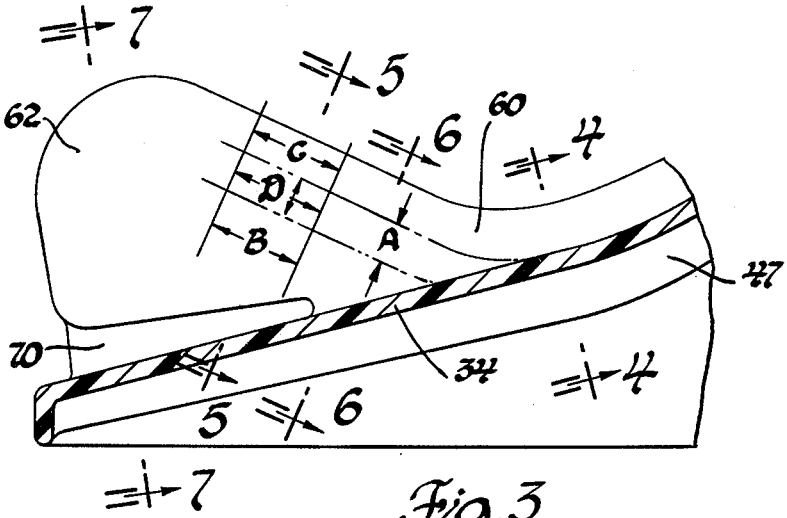
FIG. 3 is a fragmentary sectional view of the agitator taken along line 3—3 in FIG. 2.
Figure 4:
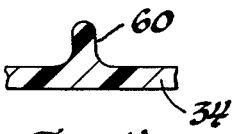
Figure 5:
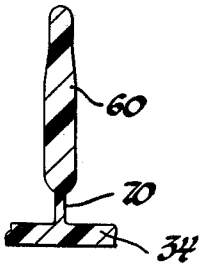

The rounded terminus 62 of each vane 60 is flexible with respect to the center column 30 by being rooted to the skirt 34 by a web 70 at the radially outer end thereof which is thinner than the rounded terminus. The rounded terminus is designed to impart a directional component to the water being oscillated which is upwardly as well as outwardly. For this purpose, the inside bottom of the vane 60 (FIG. 4) is relatively rigid while the outside bottom of the vane is rooted by web 70 (FIG. 7). The thickness of each vane is blended in molding, i.e., blend from 0.180 inch to 0.140 inch in area A; blend from 0.180 inch to 0.100 inch in area B; blend from 0.140 inch to 0.100 inch in area C; and compound blend in area D — 0.180 inch to 0.140 inch and 0.100 inch; 0.140 inch to 0.100 inch. Web 70 is 0.035 inch thick. With these specifications in an agitator skirt 34 substantially 15.56 inches in diameter, the rounded terminus 62 of each vane flexes about an axis substantially defined by section line 5—5. Upon oscillation, such vane configuration will impart a sufficient upward component to the water to float a maximum rated eighteen pound load of clothes in the washer.

The oscillating motion given to the agitator via the washer mechanism is 80 strokes per minute with each stroke consisting of 180° of rotation. This motion is relatively critical to the action of the agitator.

As aforesaid, agitator 24 has three distinct levels of washing action. The purpose of each level is different but they are interrelated.

Level I (FIG. 1), at the top, has several functions. It helps to pull the dry articles of clothing down into the washing fluid at the start of agitate. The tapered top fins 48 seem to grab the articles and pull them down. As they are pulled down, the articles are channelized or divided by the large portion 50 of the top fins. This tends to keep the toroid turning in straight planes and not revolving which would tend to angle the articles. The top fins also deflate or beat the air out of articles that billow up with air and tend to float and, finally, they generate a moderate amount of loose suds. They do not tend to whip up thick suds which would tend to "suds lock" the inner and outer tub during spin.

Level II, in the middle, has reduced vanes 52 to provide enough volume so that the articles can remain loose and unbunched, and remain channelized.

Level III, at the bottom, is the area where the bulk of the energy is imparted to the washing fluid which, in turn, moves the articles being washed. The washing fluid is moved in such a manner as to move the articles out and up along the inside wall of the inner tub 22. The outward moving water off the agitator vanes strike the bottom radius 54 of the inner tub and is directed upward, taking the articles with it. The diameter of agitator skirt 34 and thus the vane outside radius is limited to keep the agigator free. After wash spin the articles are in a compacted state at the bottom of the tub. Enough space must be provided between the agitator vanes 62 and tub 22 so that the compacted articles do not incumber the agitator vanes and stall the drive motor at the start of rinse agitate. This may be tested with low line voltage and the maximum rated load. Since the vanes are relatively flexible, this helps to free the vanes under the above conditions.

The design of vane 60 is unique and is the heart of this agitation system. The outside bottom edge of each vane 60 is rooted to the agitator skirt by a thin web 70 and the vane cross section is varied. This combination allows each vane to flex in a controlled pattern when under load and induces the washing fluid to move out and up. This in turn moves the articles being washed in a toroidal path. The highest velocity washing fluid comes off the rooted base of the vane. This is directed toward the inner tub radius. The articles are pumped outwardly and upwardly in Level III and are channelized by Level I and kept in a loose suspended state in Level II and finally pulled into Level III and the cycle repeats.

The vane height and radius are important. Each vane terminus 62 must be high enough (1.82 inches) to move a sufficient amount of washing fluid and indirectly the articles, but must not be so high that the articles are harshly rubbed. The radius (0.76 inch) of the terminus must provide a smooth exposed surface to the articles passing by it. The shape of each vane 60 as well as its flex characteristic determine the propulsion delivered to the washing fluid.

Thus vane shape, size, location, flex characteristic, and stroke all interrelate to move the articles via the washing fluid in an efficient and gentle manner.

While the embodiment of the present invention as herein disclosed constitutes a preferred form, it is to be understood that other forms might be adapted.

What is claimed is:

1. An agitator adapted to effect cleaning of fabrics in a washing machine having a liquid and fabric receiving tub and a drive mechanism adapted to impart to said agitator pivotal oscillation about a vertical axis, said agitator comprising:

a. a center column flaring at the bottom thereof into a skirt having means adapted for mounting the agitator generally vertically in the tub and for connecting the agitator to the drive mechanism, said center column including an upper level portion, a middle level action portion and a lower level action portion, b. a plurality of generally vertical fins integral with said center column, each of said fins projecting radially from said center column in each of said action portions, c. each of said fins configured as a flat obtuse triangle in the upper and middle level action portions to pull dry fabrics downwardly into liquid in the tub whie channelizing them loosely suspended in a toroidal turnover between vertical planes formed by adjacent fins, d. each of said fins configured in the lower level action portion as a radial vane gradually increasing in height in the radially outer direction to form a rounded terminus projecting vertically upwardly from said skirt for imparting energy to the liquid to move the fabric being washed radially outwardly along said skirt and upwardly along a wall of the tub, thereby to maintain the toroidal turnover, the rounded terminus of said vane being flexible with respect to said center column by being rooted to said skirt by a web at the radially outer end thereof which is thinner than said rounded terminus.

2. An agitator adapted to effect cleaning of fabrics in a washing machine having a liquid and fabric receiving tub and a drive mechanism adapted to impart said agitator pivotal oscillation about a vertical axis, said agitator comprising;

a. a center column flaring at the bottom thereof into a skirt having means adapted for mounting the agitator generally vertically in the tub and for connecting the agitator to the drive mechanism, said center column including an upper level action portion, a middle level action portion and a lower level action portion, b. a plurality of generally vertical fins integral with said center column, each of said fins projecting radially from said center column in each of said action portions, c. each of said fins configured as a flat obtuse triangle in the upper and middle level action portions to pull dry fabrics downwardly into liquid in the tub while channelizing them loosely suspended in a toroidal turnover between vertical planes formed by adjacent fins, d. each of said fins configured in the lower level action portion as a radial vane the top edge of which gradually increases in height in the radially outer direction to form a rounded terminus projecting vertically upwardly from said skirt for imparting energy to the liquid to move the fabric being washed radially outwardly along said skirt and upwardly along a wall of the tub, thereby to maintain the toroidal turnover, the rounded terminus of said vane being flexible with respect to said center column by being rooted to said skirt by a web at the radially outer end therof which is thinner than said rounded terminus, e. each of said vanes being molded of polypropylene and sufficiently blended in cross section along a longitudinal segment thereof adjacent said web which is generally perpendicular to the top edge of said vane, whereby to pump said liquid and fabric outwardly and upwardly during pivotal oscillation of said agitator.

3. In a washing machine having a liquid and fabric receiving tub and a drive mechanism adapted to impart substantially 80 strokes per minute of 180° pivotal oscillations about a vertical axis, an agitator adapted to effect cleaning of fabrics in said tub and comprising:

a. a center column flaring at the bottom thereof into a skirt having means adapted for mounting the agitator generally vertically in the tub and for connecting the agitator to the drive mechanism, said center column including an upper level action portion, a middle level action portion and a lower level action portion, b. a plurality of generally vertical fins integral with said center column, each of said fins projecting radially from said center column in each of said action portions, c. each of said fins configured as a flat obtuse triangle in the upper and middle level action portions to pull dry fabrics downwardly into liquid in the tub while channelizing them loosely suspended in a toroidal turnover between vertical planes formed by adjacent fins, d. each of said fins configured in the lower level action portion as a radial vane gradually increasing in height in the radial outer direction to form a rounded terminus projecting vertically upwardly from said skirt for imparting energy to the liquid to move the fabric being washed radially outwardly along said skirt and upwardly along a wall of the tub, thereby to maintain the toroidal turnover, the rounded terminus of said vane being flexible with respect to said center column by being rooted to said skirt by a web at the radially outer end thereof which is thinner than said rounded terminus.

* * * * *

UNITED STATES PATENT AND TRADEMARK OFFICE

CERTIFICATE OF CORRECTION

PATENT NO. : 4,018,067

DATED : April 19, 1977

INVENTOR(S) : Nick Vona, Jr., and Kenneth O. Sisson

It is certified that error appears in the above-identified patent and that said Letters Patent are hereby corrected as shown below:

Column 4, line 11 - "angle" should read -- tangle --;

line 29 - "agigator" should read -- agitator --.

Column 5, line 10 - after "upper level" insert -- action --;

line 21 - "whie" should read -- while --;

line 39 - after "impart" insert -- to --.

Column 6, line 47 - "radial" should read -- radially --.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*